US006389762B2

(12) United States Patent
Le Poire

(10) Patent No.: US 6,389,762 B2
(45) Date of Patent: May 21, 2002

(54) LINTEL

(75) Inventor: Robert A. Le Poire, Chesterfield, MO (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/760,912

(22) Filed: Jan. 16, 2001

Related U.S. Application Data

(63) Continuation of application No. 08/970,681, filed on Nov. 14, 1997.

(51) Int. Cl.[7] ..... E04C 3/02

(52) U.S. Cl. ..... 52/204.2; 52/696; 52/765; 52/213; 411/466; 411/467; 411/468; 411/457

(58) Field of Search ..... 52/696, 204.2, 52/764, 765, 213, 215, 737.2, 737.3, 730.7, 731.2, 731.1, 732.1, 734.1, 734.2; 411/466, 467, 468, 457

(56) References Cited

U.S. PATENT DOCUMENTS

| | | | |
|---|---|---|---|
| 2,844,852 | A | 7/1958 | West |
| 3,286,429 | A | 11/1966 | Ratliff, Jr. |
| 3,494,645 | A | 2/1970 | Jureit |
| 3,690,082 | A | 9/1972 | Byland |
| 4,014,146 | A | 3/1977 | DiMascio et al. |
| 4,160,350 | A | 7/1979 | Craib |
| 4,241,557 | A | 12/1980 | Jensen |
| 4,295,318 | A | 10/1981 | Perlman |
| 4,442,649 | A | 4/1984 | Birckhead et al. |
| 4,475,328 | A | 10/1984 | Reeder et al. |
| 4,738,071 | A | 4/1988 | Ezard |
| 4,862,667 | A | 9/1989 | Melland |
| 4,885,892 | A | 12/1989 | Gooding |
| 5,689,922 | A | 11/1997 | Daudet |
| 5,809,735 | A | 9/1998 | Leblanc |
| 5,852,908 | A | 12/1998 | Nankin |

FOREIGN PATENT DOCUMENTS

| | | |
|---|---|---|
| AU | A-13651/95 | 9/1995 |
| CA | 1122377 | 4/1982 |
| CA | 1122769 | 5/1982 |
| DE | 1966440 | 7/1969 |
| EP | 0 916 778 A2 | 5/1999 |
| EP | 0 916 778 A3 | 7/2000 |

(List continued on next page.)

OTHER PUBLICATIONS

European Patent Office, European Search Report, Jun. 9, 2000, App. No. 98307689.4–2303–.

*Primary Examiner*—Carl D. Friedman
*Assistant Examiner*—Dennis L. Dorsey
(74) *Attorney, Agent, or Firm*—Senniger, Powers, Leavitt & Roedel

(57) ABSTRACT

Lintels having metal side plates are described. In an exemplary embodiment, a lintel constructed in accordance with the present invention includes a generally rectangular frame of a height, length and thickness substantially corresponding to the dimensions of the opening in which the lintel is to be installed. The frame is formed by connected, first and second elongate chord members (e.g., nominal "2×N" members) that extend in spaced, substantially parallel, overlying relationship to each other. The subject lintel also includes at least one generally rectangular, metal side plate having at least first and second spaced groupings of integrally formed teeth extending from one side along opposite longitudinal edges thereof. The respective teeth groupings engage the first and second chords. The metal side plate member has a width intermediate of the height of the frame and the distance between the first and second chords, and is positioned so as to overlap portions of each of the coplanar side surfaces of the first and second chords on one side of the frame, while leaving sufficient space between its lower longitudinal edge and the bottom edge of the frame to permit convenient fastener attachment of siding or other materials.

13 Claims, 3 Drawing Sheets

FOREIGN PATENT DOCUMENTS

| | | | | |
|---|---|---|---|---|
| FR | 2501807 | | 3/1981 | |
| FR | 2501807 | * | 9/1982 | ..... 411/468 |
| FR | 2570449 A1 | * | 5/1983 | ..... 52/204.2 |
| FR | 2570449 | | 5/1983 | |
| GB | 1232593 | | 5/1971 | |
| GB | 2113740 A | | 8/1983 | |
| GB | 2 127 457 A | | 4/1984 | |
| GB | 2241003 | | 8/1991 | |
| WO | AU95/00494 | | 2/1996 | |

* cited by examiner

LINTEL

This is a continuation of application Ser. No. 08/970,681, filed Nov. 14, 1997.

FIELD OF THE INVENTION

This invention relates generally to prefabricated, structural framing members used in a broad range of construction applications and, more particularly, to a lintel having a metal side plate.

BACKGROUND OF THE INVENTION

Lintels are typically used as structural framing members over windows and doors, as girders to support roof and floor trusses, and in other residential, industrial, commercial and agricultural applications. Generally, lintels span the distance between two spaced supports and carry structural loads, e.g., the weight of the structure above the lintel.

Known lintels are frequently fabricated on-site from two pieces of nominal "2×N" lumber, e.g., 2×10 or 2×12 lumber (hereinafter referred to as "chords"), and one or more pieces of filler material, e.g., ½" thick plywood, of selected lengths for the particular application. The filler material is sandwiched between the chords, and then nails are driven through the chords and the filler material to form a composite structural member. The filler material is usually required so that the actual thickness of the composite lintel matches the width of the framing members which support the lintel.

These known composite lintels generally have far more capacity and utilize far more materials than necessary for most applications in which they are used. Furthermore, being solid, site-built members, such lintels are time-consuming to make, heavy to carry, and labor-intensive to install.

Another known type of lintel is made partly of wood and partly of steel, and is marketed under the tradename Trifold. The known Trifold lintel includes a "]" shaped steel member having a center web portion, and integral flanges that extend in the same direction from opposing side edges of the web portion. To build a Trifold lintel, a wooden frame of desired size is constructed, and the steel member web portion is nailed or screwed to, and completely covers, one side of the wooden frame. One integral flange of the steel member extends over the top surface of the wood frame, and the other flange extends over the bottom surface of the frame. The Trifold lintel can then be installed, for example, over a window or door.

Although the Trifold lintel is lighter and utilizes less unnecessary materials than the composite lintels discussed above, like such composite lintels, the Trifold lintel is time-consuming and labor-intensive to assemble because of the large number of individually driven nails or screws that normally must be used to allow the Trifold lintel to carry common roof, floor or girder loads. Further, because the web portion covers the entire side of the wooden frame upon which it is installed, it substantially impedes the application of siding and other materials to that side of the lintel.

It would be desirable to provide a lintel which does not have significant unnecessary capacity and, therefore, wastes less materials than known composite lintels. It would be desirable to provide a lintel which may be pre-fabricated in a factory for delivery to a job site to eliminate the time, expense and imprecision associated with on-site assembly. It also would be desirable to provide a lintel which is relatively light weight to reduce shipping costs to the job site and to facilitate on-site handling, and to provide a lintel to which siding materials can be readily nailed or screwed without predrilling.

SUMMARY OF THE INVENTION

These and other objects may be attained by a lintel having a metal side plate in accordance with the present invention. The metal side plate provides many advantages including that waste is substantially reduced by eliminating unnecessary extra capacity, and such side plate enables prefabrication of the lintel in a factory for delivery to a job site. Use of the metal side plate also results in a relatively light weight lintel, which reduces shipping costs to the job site and facilitates on-site handling. In addition, with each of the embodiments of the subject lintel, siding materials can be readily nailed or screwed to the same side of the lintel to which the metal side plate is attached, without predrilling.

More particularly, and in an exemplary embodiment, a lintel constructed in accordance with the present invention includes a generally rectangular wood frame of a height, length and thickness substantially corresponding to the dimensions of the opening in which the lintel is to be installed. The frame is formed by connected first and second elongate chord members (e.g., nominal "2×N" members) that extend in spaced, substantially parallel, overlying relationship to each other.

The subject lintel also includes at least one generally rectangular metal side plate having at least first and second spaced groupings of integrally formed teeth extending from one side along opposite longitudinal edges thereof. The first and second teeth groupings respectively engage the first and second chords. The metal side plate member has a width intermediate of the height of the frame and the distance between the first and second chords, and is positioned so as to overlap portions of coplanar side surfaces of the first and second chords on one side of the frame, while leaving a sufficient portion of one of the coplanar side surfaces exposed between its lower longitudinal edge and the bottom edge of the frame, to permit convenient fastener attachment of siding or other materials.

Many alternate embodiments of the subject lintel are contemplated, and several are specifically disclosed. For example, in one alternate embodiment generally intended for applications where the subject lintel may be required to carry heavier loads, the frame is provided with one or more internal stiffening members that are connected to and extend transversely between the first and second elongate chords. With this embodiment, the metal side plate may also be fabricated to include a third grouping of integral teeth spaced intermediate of the first and second groupings of teeth for engagement with the stiffening members.

In yet another embodiment of the subject lintel, a plurality of metal side plates are provided at predetermined locations spaced lengthwise along at least one side of the lintel frame to provide openings through which electrical, plumbing or other members may be conveniently passed without the need for drilling or cutting the subject lintel. In addition, for applications where the subject lintel may be required to carry extreme loads, metal side plates may be installed on both inner and outer sides of the lintel frame.

The subject lintel is a structural component capable of carrying substantial loads which minimizes unnecessary materials, production costs and waste. The lintel also lends itself to being prefabricated under factory conditions to reduce assembly costs, and may be made with a generally hollow inner core to reduce shipping costs. The hollow inner core also makes the lintel relatively light weight and easy to handle on-site. Optionally, the hollow inner core may be filled, preferably with a light weight material, to provide enhanced thermal or sound insulation performance. In addition, and in each of the various embodiments of the subject lintel described above, a portion of the lintel frame underlying the metal side plate is exposed, enabling convenient attachment of siding or other materials to the lintel.

DETAILED DESCRIPTION

Set forth below is a description of various embodiments of lintels constructed in accordance with the present invention. The term lintel, as used herein, refers to a structural framing member which spans the distance between two spaced supports and carries structural loads, e.g., the weight of the structure above the lintel. Lintels typically are utilized over windows and doors, as girders to support roof and floor trusses, and in other residential, industrial, commercial and agricultural applications.

Figure 1:
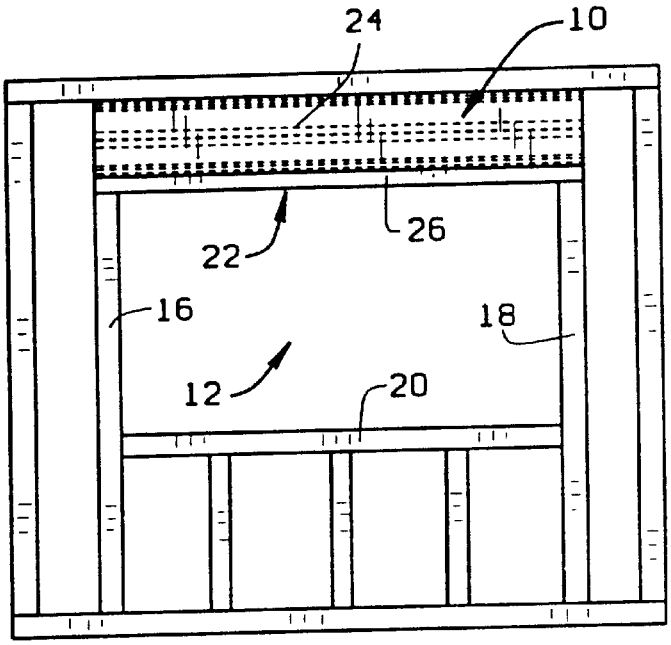
FIG. 1 is a front view of a portion of a building frame for a window including an exemplary embodiment of a lintel constructed in accordance with the present invention.

One exemplary lintel application is illustrated in FIG. 1, wherein a lintel 10 constructed in accordance with the present invention spans the width of a window opening 12 formed by building framing members 16, 18, and 20. Lintel 10 is supported on framing members 16 and 18, and lintel 10 includes a wood frame 22 and a metal side plate 24. Lintel 10 supports the weight of the structure (not shown) above window opening 12. A portion 26 of wood frame 22 underlying metal side plate 24 is exposed, which enables convenient attachment of siding or other materials to lintel 10.

Figure 2:
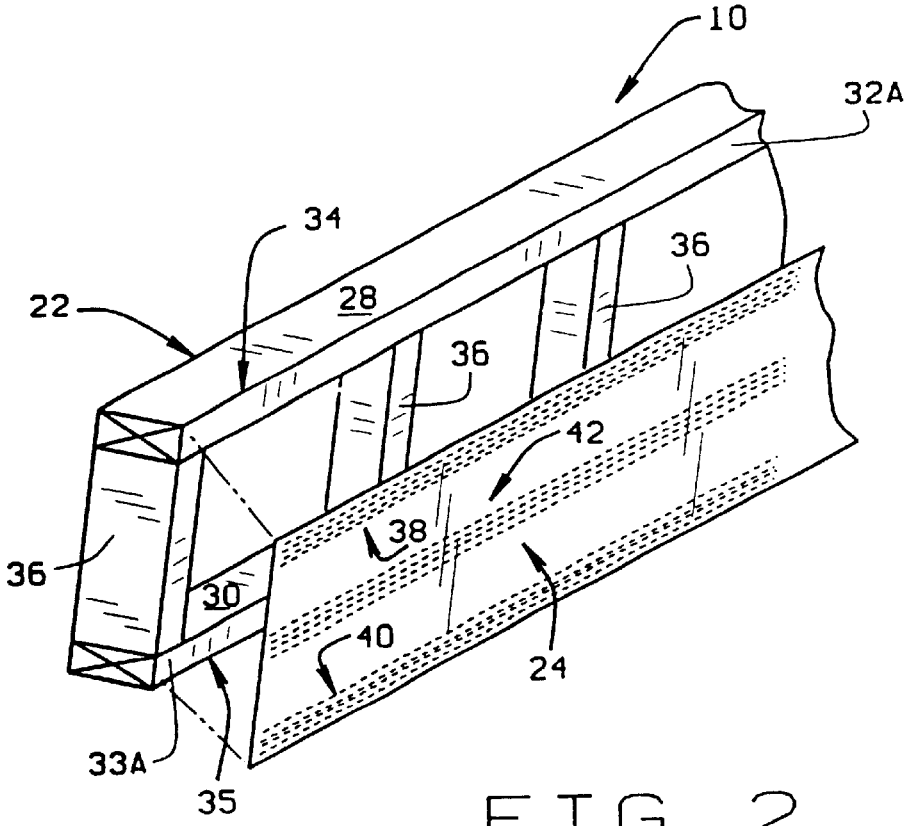
FIG. 2 is a perspective partially exploded view of the lintel shown in FIG. 1.

FIG. 2 is a perspective, partially exploded view of a portion of lintel 10 and more clearly illustrates generally rectangular wood frame 22 which has a height, length and thickness substantially corresponding to the opening in which lintel 10 is installed above the window opening 12 (not shown in FIG. 2). Frame 22 includes first and second elongate chords 28 and 30 which extend in spaced, substantially parallel, overlying relationship to each other. Chords 28 and 30 provide inner and outer side pairs of spaced substantially coplanar surfaces 32A, 32B, 33A and 33B that respectively extend to top and bottom side edges of frame 22. (Only top and bottom side edges 34 and 35 and coplanar surfaces 32A and 33A on the inner side of the frame 22 are depicted in FIG. 2.) Frame 22 also includes stiffening members 36 that are connected to and extend transversely between the first and second elongate chords 28 and 30. Stiffening members 36 are shown extending substantially vertically, or perpendicularly, to chords 28 and 30, although it is contemplated that the stiffening members 36 could extend diagonally, or angularly, relative to chords 28 and 30 without departing from the intended scope of the present invention. Chords 28 and 30 and stiffening members 36 may be nominal "2×N" lumber, e.g., 2×4 or 2×6 lumber, of selected lengths depending upon the specific application.

Lintel 10 also includes metal side plate 24 which has first and second spaced groupings 38 and 40 of teeth. Teeth groupings 38 and 40 extend from one side of the side plate 24 along opposite longitudinal edges thereof. The side plate 24 also includes a third grouping 42 of teeth spaced from and intermediate of the first and second teeth groupings 38 and 40. At least some teeth of the first grouping 38 are engaged with the first chord 28, at least some teeth of the second grouping 40 are engaged with the second chord 30, and at least some teeth of third grouping 42 are engaged with the stiffening members 36.

Figure 3:
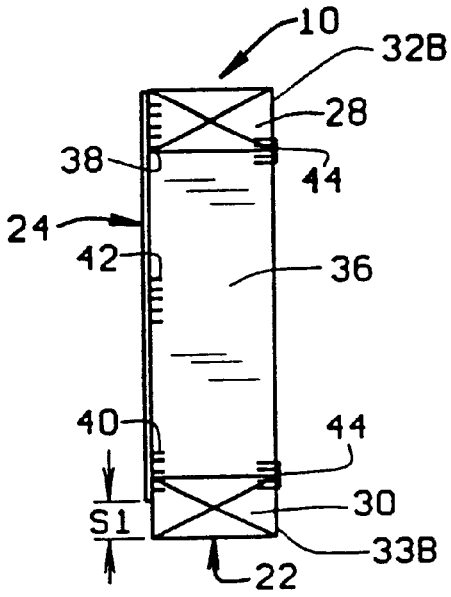
FIG. 3 is a schematic side view of the lintel shown in FIGS. 1 and 2.

FIG. 3 is a schematic side view of lintel 10. As clearly shown in FIG. 3, side plate 24 does not extend the full height of frame 22. Specifically, metal side plate 24 has a width intermediate of the height of frame 22 and the distance between first and second chords 28 and 30, and is positioned so as to overlap portions of each of the coplanar side surfaces of first and second chords 28 and 30 on one side of frame 22, while leaving a sufficient space S1 (e.g., about one inch) between its lower longitudinal edge and the bottom edge of frame 22 to permit convenient fastener attachment of siding or other materials.

The metal plate 24 is preferably formed of ASTM A653, Grade 33 or better galvanized sheet steel, and most preferably of such sheet steel with a thickness between 14 and 24 gauge. Such sheet steel material is available in coil form, in various widths, and the metal side plate 24 may be fabricated therefrom, for example, by positioning a portion of the coil of the sheet metal material in a conventional punch press and then simultaneously punching the spaced teeth groupings 38, 40, and 42 to extend from one side of the portion of sheet metal coil. The punched portion may then be cut off to the desired lintel length. The teeth in the teeth groups 38, 40 and 42 may be of conventional construction such as the teeth of known metal connector plates used to form the joints of metal plate connected wood trusses, but most preferably are of the type employed with the MII 20 connector plate marketed by Mitek Industries, Inc. Side plate 24 can be provided to prefabricators of the subject lintel in a roll or pre-cut form in various lengths.

As also shown in FIG. 3, connector plates 44 may be utilized on the side of frame 22 opposite side plate 24. Connector plates 44 typically are located at the interfaces between chords 28 and 30 and stiffening members 36, and such connector plates 44 provide secure engagement between stiffening members 36 and chords 28 and 30.

To fabricate lintel 10, chords 28 and 30 and stiffening members 36 are preferably positioned on an assembly table and jigged in the general outline of frame 22, with connector plates 44 positioned under the interfaces of the chords 28 and 30 and of the stiffening members 36 with their teeth pointed upwardly. Side plate 24 is then located over the other or top side of the chords 28 and 30 and stiffening members 36 so that at least a predetermined number of teeth of first grouping 38 are over first chord 28, of second grouping 40 are over second chord 30 and of third grouping 42 are over stiffening members 36, and so that lower longitudinal edge of the plate 24 is spaced from the lower edge 35 of the frame 22 a distance sufficient to allow convenient nail or screw attachment of siding materials to the chord 30. This spacing is preferably about 1 inch. Side plate 24 and the connector plates 44 are then engaged with chords 28 and 30 and stiffening members 36 by a press or a roller in a manner known in the art. Alternatively, the assembly may be assembled one side at a time and then flipped over for completion of the assembly process.

Lintel 10 provides the advantages of reducing waste and costs. For example, lintel 10 has some excess weight bearing capacity, but lintel 10 does not have excess capacity to the same extent of known composite lintels. Further, side plate 24 reduces the amount of material required to fabricate lintel 10 and therefore reduces the overall cost of lintel 10. In addition, lintel 10 is light weight as compared to known composite lintels made of wood.

Lintel 10 also can be readily pre-fabricated at a factory and delivered to a job site completely assembled. Therefore, a skilled carpenter would not be required to make a lintel on-site, which enhances worker productivity. Additionally, the above described metal side plate lintel 10 leaves sufficient space between the side plate lower longitudinal edge and the bottom edge of the frame to permit fastener attachment of siding or other materials to lintel 10 without predrilling the side plate or splitting the lower chord 30 of the frame 22.

Figure 4:
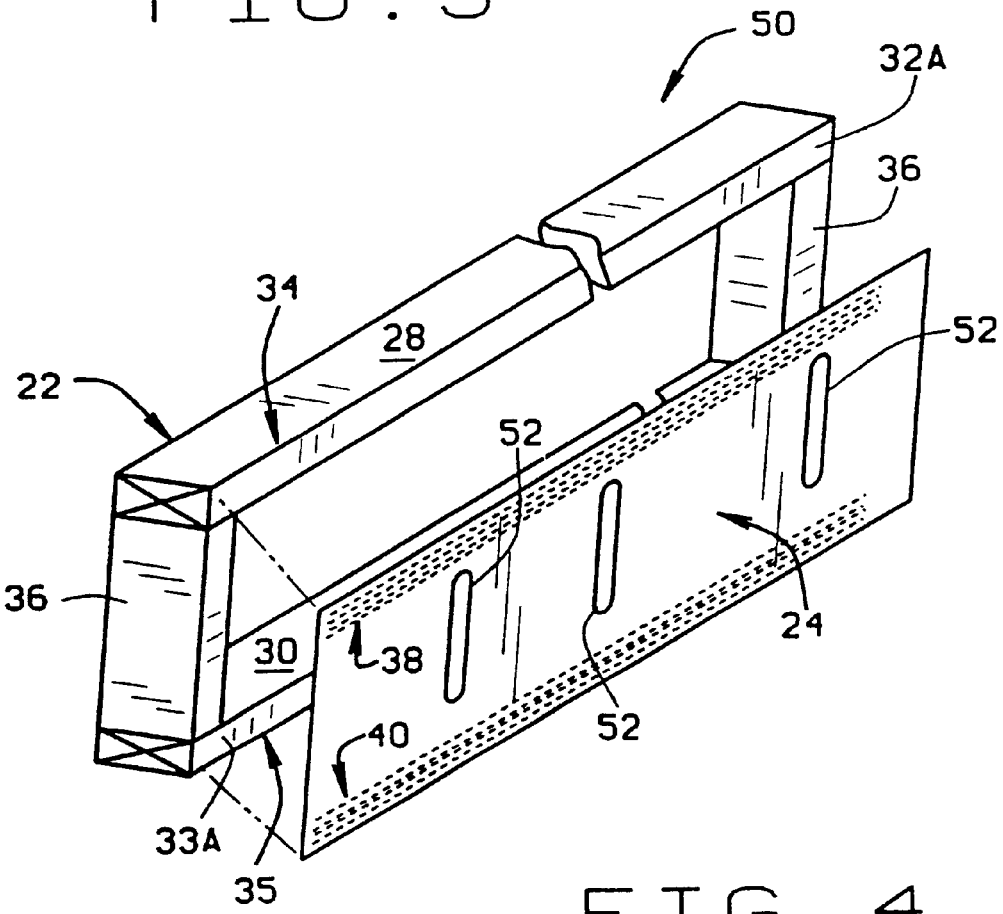
FIG. 4 is a perspective partially exploded view of an alternate embodiment of a lintel constructed in accordance with the present invention.

FIG. 4 is a perspective view of an alternative embodiment of a lintel 50 constructed in accordance with the present invention. As compared to lintel 10, lintel 50 typically would be utilized in lighter load applications. Components of lintel 50 which are identical to components of lintel 10 are referenced in FIG. 4 using the same reference numerals used in connection with lintel 10. As compared to lintel 10, lintel 50 includes stiffening members 36 only at opposing ends of frame 22 and the intermediate stiffening members are eliminated. In addition, and with the elimination of the intermediate stiffening members, third grouping 42 of teeth in side plate 24 is eliminated. The side plate 24 also is illustrated with optional stiffening ribs 52 which provide extra rigidity for plate 24.

Figure 5:
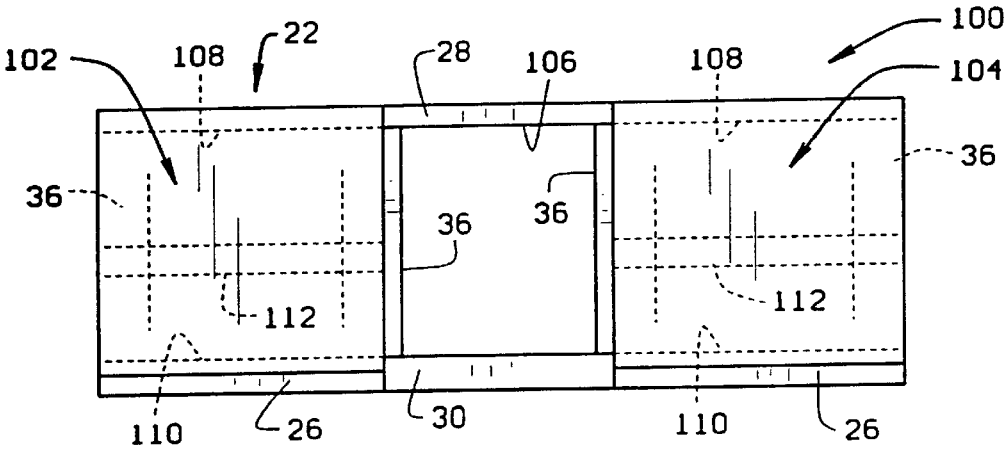
FIG. 5 is a front view of yet another embodiment of a lintel constructed in accordance with the present invention and including two metal side plates installed at locations spaced lengthwise along one side of the lintel frame to provide an opening for the passage of heating, electrical, plumbing or other materials.
Figure 6:
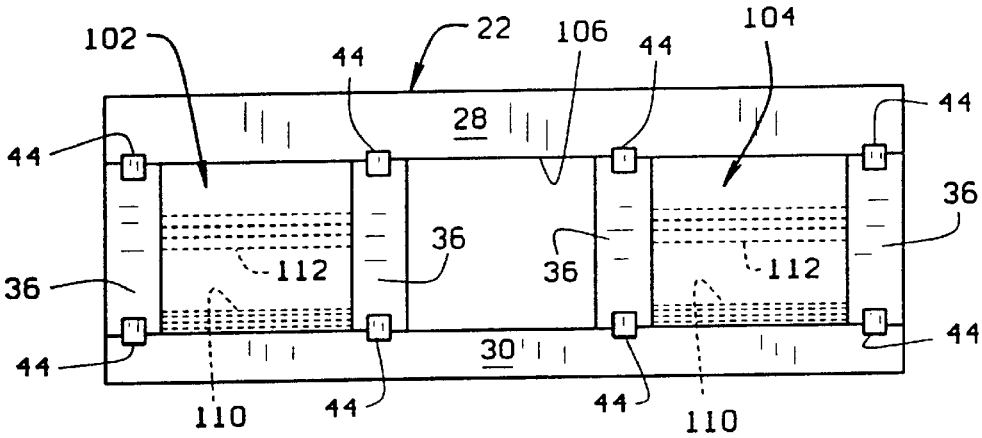
FIG. 6 is a rear view of the lintel shown in FIG. 5.

FIGS. 5 and 6 are views of opposing sides of another embodiment of a lintel 100 constructed in accordance with the present invention. Components of lintel 100 which are identical to components of lintel 10 are referenced in FIGS. 5 and 6 using the same reference numerals used in connection with lintel 10. Lintel 100 includes wood frame 22 and rather than a single metal side plate, a plurality of metal side plates 102 and 104 are positioned at predetermined locations spaced lengthwise along at least one side of frame 22 to provide an opening 106 through which electrical, plumbing or other members may be conveniently passed without the need for drilling or cutting lintel. Side plates 102 and 104 include first, second, and third groups 108, 110 and 112 of teeth to engage chords 28 and 30 and stiffening members 36.

Figure 7:
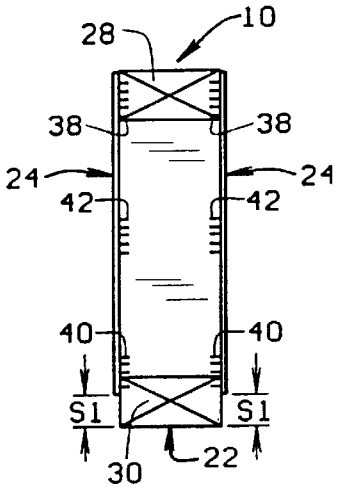
FIG. 7 is a schematic side view of a lintel constructed in accordance with still yet another embodiment of the present invention and having metal side plates installed on both sides of a lintel frame.

FIG. 7 is a schematic side view of a lintel 150 constructed in accordance with yet another embodiment of the present invention and having metal side plates 24 installed on both sides of lintel frame 22. Components of lintel 150 which are identical to components of lintel 10 are referenced in FIG. 7 using the same reference numerals used in connection with lintel 10. Use of side plates 24 on both sides of frame 22 may be required in applications where lintel 150 is to carry extreme loads. In addition, light weight material can be located in the spaces (not shown in FIG. 7) between stiffening members 36 before engaging the second plate 24 to frame 22 so that such material is trapped within lintel 150. Such use of material provides enhanced thermal or sound insulation performance for lintel 150.

The various lintel embodiments described above are structural components capable of carrying substantial loads which minimize unnecessary materials, production costs and waste. Such lintels lend themselves to being prefabricated under factory conditions to reduce assembly costs. The lintels also are relatively light weight and easy to handle on-site. In addition, and in each of the various embodiments of the subject lintel described above, a portion of the lintel frame underlying the metal side plate is exposed, enabling convenient attachment of siding or other materials to the lintel.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A lintel, comprising:

a frame comprising first and second elongate chords extending substantially parallel to, and spaced from each other, and stiffening members extending between and secured to said first and second chords; and a first, generally rectangular side plate comprising first, second and third spaced groupings of teeth, each of said first, second and third groupings of teeth extending in a direction generally parallel to said first and second chords, and being spaced from the nearest adjacent grouping of teeth by a region of said first side plate free of teeth, at least some teeth of said first grouping engaged with said first chord, at least some teeth of said second grouping engaged with said second chord, and at least some teeth of said third group engaged with at least one of said stiffening members.

2. lintel as set forth in claim 1 wherein at least some of the teeth of said third grouping engaging each of said stiffening members.

3. A lintel as set forth in claim 1 wherein the stiffening members are free of engagement with at least one of said first group and said second group of teeth.

4. A lintel as set forth in claim 2 wherein there are at least three of said stiffening members spaced apart from each other along the length of the lentil.

5. A lintel as set forth in claim 4 wherein said stiffening members are made of wood.

6. A lintel as set forth in claim 1 further comprising a second, generally rectangular side plate comprising first, second and third spaced groupings of teeth, each of said first, second and third groupings of teeth extending in a direction generally parallel to said first and second chords, and being spaced from the nearest adjacent grouping of teeth by a region of said first side plate free of teeth, at least some teeth of said first grouping engaged with said first chord, at least some teeth of said second grouping engaged with said second chord, and at least some teeth of said third group engaged with at least one of said stiffening members, the second side plate being disposed on the same side of the lintel as the first side plate in a position spaced longitudinally of the first side plate whereby the first and second side plates define an opening through the lintel.

7. A lintel as set forth in claim 6 wherein said first side plate is located on one longitudinal side of the lintel, an opposite longitudinal side of the lintel being free of any side plate.

8. A lintel, comprising:

first and second elongate chords extending substantially parallel to, and spaced from each other, and stiffening members extending between and secured to said first and second chords; and a first, generally rectangular side plate comprising first and second spaced groupings of teeth, each of said first and second groupings of teeth being struck from the material of the first side plate and extending in a direction generally parallel to said first and second chords, and being spaced from the each other by a region of said first side plate free of teeth, at least some teeth of said first grouping engaged with said first chord, and at least some teeth of said second grouping engaged with said second chord, and a third grouping of teeth separated by respective regions of the side plate free of teeth from said first and second groupings of teeth, at least some of said third grouping of teeth engaging the stiffening members;

said first side plate being located on one side of the lintel, an opposite side of the lintel being free of any side plate.

9. A lintel as set forth in claim 8 wherein the stiffening members are free of engagement with at least one of said first group and said second group of teeth.

10. A lintel as set forth in claim 8 further comprising a second, generally rectangular side plate comprising first and second spaced groupings of teeth, each of said first and second groupings of teeth extending in a direction generally parallel to said first and second chords, and being spaced from each other by a region of said second side plate free of teeth, at least some teeth of said first grouping engaged with said first chord, and at least some teeth of said second grouping engaged with said second chord, the second side plate being disposed on the same side of the lintel as the first side late in a position spaced longitudinally of the first side plate whereby the first and second side plates define an opening through the lintel.

11. A lintel as set forth in claim 8 wherein there are at least three of said stiffening members spaced apart from each other along the length of the lentil.

12. A lintel as set forth in claim 11 wherein said stiffening members are made of wood.

13. A method of constructing a wall comprising the steps of:

arranging studs between an upper and lower plate having a substantially uniform maximum spacing except at an opening in the wall wherein the spacing between laterally adjacent studs is greater than said maximum spacing;

providing a lintel comprising first and second elongate chords extending substantially parallel to, and spaced from each other, and a generally rectangular side plate comprising first and second spaced groupings of teeth, at least some teeth of said first grouping engaging said first chord, and at least some teeth of said second grouping engaging said second chord, a region of said side plate between said first and second groupings of teeth being free of teeth, said providing step further comprises the step of providing a third grouping of teeth spaced by regions of the side plate free of teeth from said first and second groupings of teeth, at least some of the teeth of said third grouping engaging wooden stiffening members arranged between the upper and lower chords;

arranging the lintel between the upper and lower plates across an upper edge of the opening in the wall; and securing the upper and lower plates, studs and lintel together.

* * * * *

UNITED STATES PATENT AND TRADEMARK OFFICE

CERTIFICATE OF CORRECTION

PATENT NO. : 6,389,762 B2
DATED : May 21, 2002
INVENTOR(S) : Robert A. LePoire

It is certified that error appears in the above-identified patent and that said Letters Patent is hereby corrected as shown below:

Column 8,
Line 2, “late” should read -- plate --.

Signed and Sealed this

Twenty-ninth Day of October, 2002

*Attest:*

*Attesting Officer*

JAMES E. ROGAN
*Director of the United States Patent and Trademark Office*